US007069596B2

(12) United States Patent
Rees

(10) Patent No.: US 7,069,596 B2
(45) Date of Patent: Jul. 4, 2006

(54) BABY BIB

(75) Inventor: Arnold Edward Rees, Tyne and Wear (GB)

(73) Assignee: Jackel International Ltd, Cramlington (GB)

( * ) Notice: Subject to any disclaimer, the term of this patent is extended or adjusted under 35 U.S.C. 154(b) by 0 days.

(21) Appl. No.: 10/499,367

(22) PCT Filed: Dec. 11, 2002

(86) PCT No.: PCT/GB02/05625

§ 371 (c)(1),
(2), (4) Date: Oct. 7, 2004

(87) PCT Pub. No.: WO03/053183

PCT Pub. Date: Jul. 3, 2003

(65) Prior Publication Data

US 2005/0028239 A1 Feb. 10, 2005

(30) Foreign Application Priority Data

Dec. 20, 2001 (GB) ..... 0130542.4

(51) Int. Cl.
*A41B 13/00* (2006.01)

(52) U.S. Cl. ..... 2/49.1; 2/52

(58) Field of Classification Search ..... 2/48, 2/49.1, 49.2, 49.4, 49.5, 50, 51, 52, 49.3, 2/46, 69, 102, 87

See application file for complete search history.

(56) References Cited

U.S. PATENT DOCUMENTS

| | | | | | |
|---|---|---|---|---|---|
| 3,329,969 | A * | 7/1967 | Farber et al. | ..... | 2/49.3 |
| 3,608,092 | A | 9/1971 | Taranto | | |
| 4,787,099 | A * | 11/1988 | Mack | ..... | 2/49.1 |
| 4,811,428 | A * | 3/1989 | Waldman et al. | ..... | 2/49.3 |
| 4,884,299 | A * | 12/1989 | Rose | ..... | 206/390 |
| 5,509,141 | A * | 4/1996 | Saltzman | ..... | 2/49.2 |
| 5,546,960 | A * | 8/1996 | Billgren | ..... | 128/849 |
| 5,672,056 | A * | 9/1997 | Fisher et al. | ..... | 433/137 |
| 5,794,266 | A * | 8/1998 | Han | ..... | 2/159 |
| 5,913,406 | A * | 6/1999 | Lofgren et al. | ..... | 2/51 |
| 6,363,530 | B1 * | 4/2002 | Lampson et al. | ..... | 2/49.1 |
| 2004/0028935 | A1 * | 2/2004 | Hauke | ..... | 428/537.5 |

* cited by examiner

*Primary Examiner*—Amy B. Vanatta
(74) *Attorney, Agent, or Firm*—Stites & Harbison PLLC; Ross F. Hunt, Jr.

(57) ABSTRACT

A baby bib comprises a body portion (2) of a plastics material above which is formed an opening (8) to receive the baby's neck, the rear surface of the body portion (2) being embossed to provide areas of relief (14) for engagement with the baby's skin. Preferably the bib is of a flexible plastics material which can be rolled up and retained in a compacted condition.

5 Claims, 3 Drawing Sheets

BABY BIB

TECHNICAL FIELD

This invention relates to baby bibs and more particularly to such bibs of plastic.

BACKGROUND TO THE INVENTION

It is not unusual for a bib worn by a baby on feeding to make direct contact with the chest of the baby.

If the bib is of plastic, there is a possibility of the skin of the baby being irritated by the plastic of the bib, or in some instances for there to be an allergic reaction to the plastic of the bib. Such reactions are heightened by skin perspiration at the interface between the reverse side of the bib and the body of the baby.

In warm weather conditions, and in regions of high humidity, this effect worsens.

It is currently believed that the high level of protein contained in certain flexible plastic or thermoplastic elastomer materials may be the cause of some of the allergic reactions, and efforts are being made to limit or reduce the potential for such reactions experienced as a result of skin contact with these materials.

SUMMARY OF THE INVENTION

According to the present invention there is provided a baby bib comprising a body portion of a plastics material above which is formed an opening to receive the baby's neck, characterised in that the rear surface of the body portion is embossed to provide areas of relief for engagement with the baby's skin.

It will be appreciated that such an arrangement reduces the area of contact of the bib with the baby's skin and allows air to flow between the bib and the skin thereby reducing the likelihood of perspiration being generated.

The areas of relief may comprise a plurality of bosses symmetrically disposed about the rear surface of the body portion.

Conveniently the bib comprises a moulded sheet of flexible plastics material in which the areas of relief are integrally formed.

In a preferred embodiment of the invention, the baby bib is a thin moulded sheet of a flexible plastics material including a body portion and a pair of straps extending from opposed sides of the body portion to define an opening to receive the baby's neck, co-operating fastening means being provided at or adjacent the ends of the straps to enable adjustable fastening of the bib around the baby's neck, supplementary fastening means being formed in or on the body portion adjacent the opening whereby, on rolling up the body portion, the fastening means on the straps cooperate with the supplementary fastening means on the body portion to retain the bib in its rolled up condition.

It will be appreciated that such a bib can readily be rolled up into a compact size and retained therein for travel or storage purposes.

Preferably the fastening means on the straps includes a popper on one of the straps adapted to be received in any one of a plurality of corresponding apertures in the other strap, the supplementary fastening means comprising an aperture in the body portion adapted to receive therein the popper with the body portion in its rolled up condition.

DESCRIPTION OF THE PREFERRED EMBODIMENTS

Figure 1:
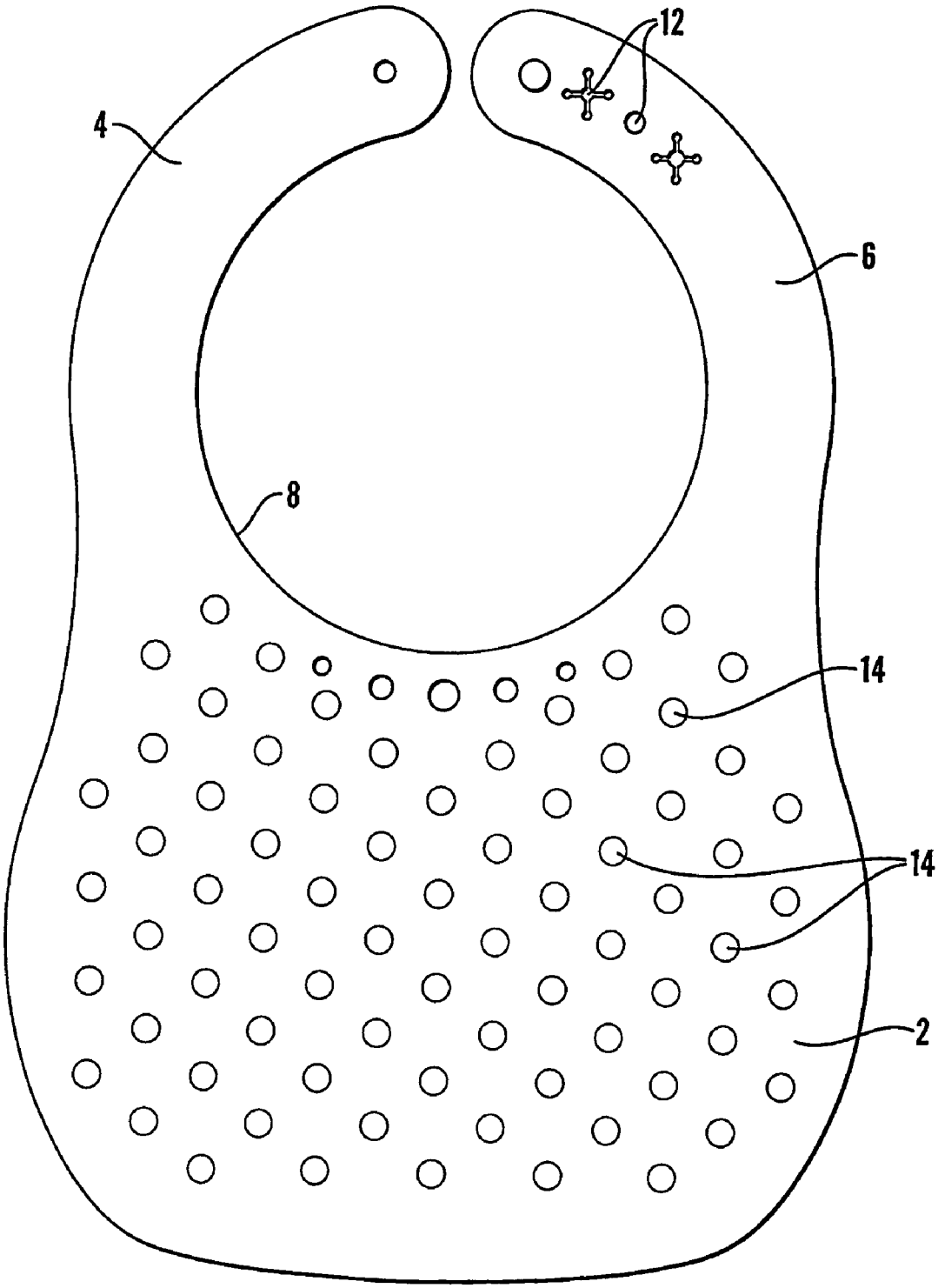
FIG. 1 is a rear view of a baby bib according to the invention.
Figure 2:
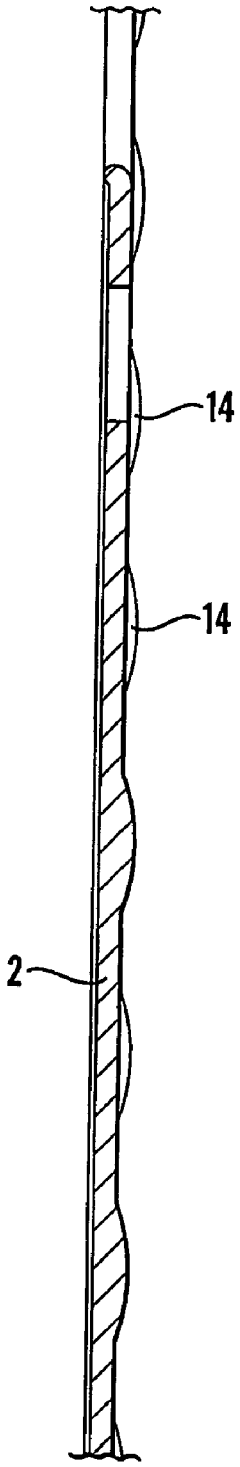
FIG. 2 is a vertical section through part of the body portion of the bib of FIG. 1.

Referring to FIGS. 1 and 2, the illustrated bib is integrally moulded from a single sheet of flexible plastics material such as a thermoplastic elastomer (TPE), silicone rubber, flexible PVC or the like.

The bib includes a body portion 2 and a pair of straps 4,6 defining a substantially circular opening 8 to receive therein the baby's neck. A stud 10 (not shown in FIG. 1) projects from the front face of the strap 4 adjacent one end thereof, and is adapted to be received in one of a series of apertures 12 in the other strap 6 to retain the bib on the baby in conventional manner.

The front surface of the body portion 2 is generally smooth for ease of cleaning. However, the rear surface of the body portion 2 is provided with a symmetrical array of bosses 14 upstanding therefrom, each boss being of circular configuration as seen in FIG. 1 and of shallow depth as seen in FIG. 2.

Such an arrangement reduces the area of contact of the rear surface of the bib with the baby's skin and also allows a flow of air to circulate between the bib and the baby's skin to reduce the likelihood of perspiration being generated. This in turn reduces the potential for the baby to suffer an allergic reaction.

The raised pattern on the rear surface of the bib may take any one of a number of different forms which may or may not be symmetrically disposed on the body portion 2, while the bosses 14 may be other than circular. In all instances, however, air is allowed to flow next to the baby's skin, and, should perspiration still occur in extreme circumstances, the relieved nature of the rear surface of the bib will not trap or retain perspiration next to the skin but allows it to drain.

The bib may incorporate an integrally formed spillage collection scoop at the lower regions of the body portion.

Figure 3:
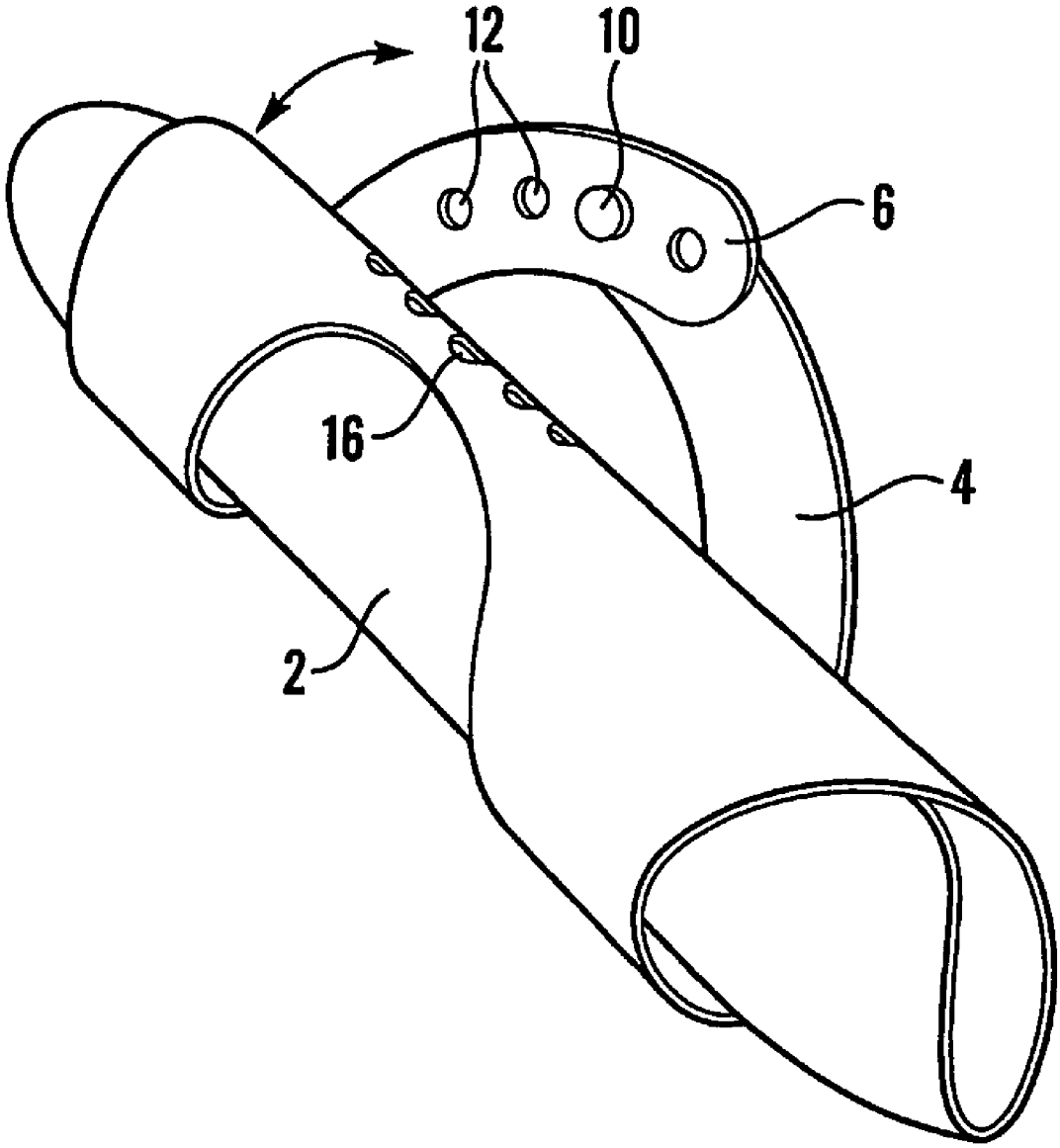
FIG. 3 shows a bib according to the invention in a partially rolled up condition.

FIG. 3 illustrates a flexible bib of the same basic construction as that of FIGS. 1 and 2 and showing the stud or popper 10 for fastening the straps 4,6 together. Formed in the body portion 2 of the bib just below the lower regions of the opening 8 and substantially centrally of the body portion 2 is an aperture 16 in which can be received the stud 10.

More particularly, and for the purposes of storage or transportation, the bib, with its straps 4,6 fastened together, can be rolled up from the bottom end of the body portion 2 and over the front surface thereof to the condition shown in FIG. 3. In this rolled up condition, the head of the stud 10 is brought in line with the aperture 16, and the stud can be inserted through this aperture from the rear of the body portion 2 through to the front thereof to retain the bib in its compacted state.

The fastening means between the straps 4,6 may be other than stud and apertures, as may the means by which the bib is retained in its rolled up condition.

Bibs according to the invention lend themselves to conventional manufacturing techniques by thermoplastic injection moulding, with the bosses 14 conveniently being relatively shallow in depth to avoid difficulties in manufacture.

The invention claimed is:

1. A baby bib adapted to fit under a baby's chin and extend downwardly therefrom and comprising a body portion of a plastics material above which is formed an opening to receive the baby's neck, characterized in that the rear surface of the body portion is embossed to provide discrete areas of relief of the plastics material for engagement with the baby's skin so as to allow, in use, air to flow between the bib and the baby's skin, said baby bib comprising a thin molded sheet of flexible plastics material including said body portion and a pair of straps having ends, the straps extending from opposed sides of the body portion to define the opening to receive the baby's neck, co-operating fastening means being provided at or adjacent the ends of the straps to enable adjustable fastening of the bib around the baby's neck, supplementary fastening means being formed in or on the body portion adjacent to and just below the opening whereby, on rolling up the body portion, the fastening means on the straps co-operate with the supplementary fastening means on the body portion to retain the bib in its rolled up condition, the fastening means on the straps includes a popper on one of the straps adapted to be received in any one of a plurality of corresponding apertures in the other strap, the supplementary fastening means comprising an aperture in the body portion adapted to receive therein the popper with the body portion in its rolled up condition.

2. A bib as claimed in claim 1 in which the areas of relief comprise a plurality of bosses symmetrically disposed about the rear surface of the body portion.

3. A bib as claimed in claim 1 in which the bib comprises a molded sheet of flexible plastics material in which the areas of relief are integrally formed.

4. A bib as claimed in claim 1, wherein the bib comprises a smooth front surface for ease of cleaning.

5. A bib as claimed in claim 1 wherein plastics material of the bib comprises a thermoplastic injection molded material.

* * * * *